US008777143B2

(12) United States Patent
Niklewski et al.

(10) Patent No.: US 8,777,143 B2
(45) Date of Patent: Jul. 15, 2014

(54) ANTI-SPIN SYSTEM FOR THE HEAD OF A CONE CRUSHER

(75) Inventors: Andrzej Niklewski, São Paulo-SP (BR); Paulo Barscevicius, Sorocaba-SP (BR)

(73) Assignee: Metso Brasil Industria E Comercio Ltda., Sorocaba-SP (BR)

( * ) Notice: Subject to any disclaimer, the term of this patent is extended or adjusted under 35 U.S.C. 154(b) by 275 days.

(21) Appl. No.: 13/201,055

(22) PCT Filed: Mar. 18, 2010

(86) PCT No.: PCT/BR2010/000089

§ 371 (c)(1),
(2), (4) Date: Nov. 10, 2011

(87) PCT Pub. No.: WO2010/105323

PCT Pub. Date: Sep. 23, 2010

(65) Prior Publication Data

US 2012/0061499 A1 Mar. 15, 2012

(30) Foreign Application Priority Data

Mar. 19, 2009 (BR) ..... 0900587

(51) Int. Cl.
*B02C 2/06* (2006.01)

(52) U.S. Cl.
USPC ..... 241/215

(58) Field of Classification Search
USPC ..... 241/207–216
See application file for complete search history.

(56) References Cited

U.S. PATENT DOCUMENTS

| | | | |
|---|---|---|---|
| 4,750,681 | A | 6/1988 | Sawant et al. |
| 6,315,225 | B1 | 11/2001 | Karra |
| 2003/0136865 | A1 | 7/2003 | Karra |

FOREIGN PATENT DOCUMENTS

| | | |
|---|---|---|
| EP | 0 093 069 | 11/1983 |
| FR | 2 848 880 | 6/2004 |

*Primary Examiner* — Mark Rosenbaum
(74) *Attorney, Agent, or Firm* — Abelman, Frayne & Schwab

(57) ABSTRACT

The anti-spin system is applied to a cone crusher having a structure (10) carrying an upper housing (20) and a vertical axle (30); an eccentric element (40) to be rotated around the vertical axle (30); and a cone head (60) disposed inside the upper housing (20) and being axially and rotatively supported on the structure (10) and radially supported around the eccentric element (40). The anti-spin system comprises a braking bush (70) carried by the cone head (60) or by the structure (10), and an annular shoe (80) carried by the other of said parts, which are pressed against each other, by action of the inertial centrifugal force acting on the cone head (60), upon "no-load" operation of the crusher, to generate a friction force opposite and superior to that generated between the cone head (60) and the eccentric element (40) and to prevent the latter from rotatively dragging the cone head (60).

10 Claims, 4 Drawing Sheets

ANTI-SPIN SYSTEM FOR THE HEAD OF A CONE CRUSHER

FIELD OF THE INVENTION

The present invention relates to a constructive system applied to a cone crusher of the type which comprises a structure, an upper housing and a vertical axle mounted in the structure, and a conically shaped head disposed in the interior of the upper housing to define a crushing cavity therewith and which is displaced, in an oscillating movement around the vertical axle, by an eccentric element radially supporting the head and which is rotated by an adequate drive mechanism.

More specifically, the present invention refers to a constructive system for preventing the head of said crusher from rotating jointly with the eccentric element when the crusher is in the "no-load" operation, that is, when no material is being crushed in the interior of the crushing cavity.

BACKGROUND OF THE INVENTION

In the cone crushers of the type defined above, when the material to be crushed is fed into the crushing cavity, this material is simultaneously frictioned against the head and the upper housing, causing the cone head to rotate in a direction opposite to the rotation direction of the eccentric element. The material being supplied prevents the cone head from being rotatively dragged by the eccentric element, maintaining said cone head rotatively stationary relative to the upper housing.

Thus, in the "on-load" operation, the cone head is prevented from rotating with the eccentric element, by the braking action provided by the material being crushed. The braking force exerted by the material is greater than the friction force applied on the opposite direction, between the cone head and the rotating eccentric element.

However, during the "no-load" operation of the crusher, that is, when no material is being crushed in the crushing cavity, and the eccentric element continues to rotate around the vertical axle, there is no material in the crushing cavity to exert a frictional braking force between the cone head and the upper housing mounted to the structure of the crusher.

In the "no-load" operation, the friction between the cone head and the eccentric element is sufficient to make the cone head be rotatively dragged by the eccentric element, tending to reach the same operational rotation of the latter.

Nevertheless, in said "no-load" operating condition, when the material to be crushed is fed into the crushing cavity, it makes frictional contact simultaneously with the stationary crushing surface of the upper housing and with the rotating crushing surface of the cone head, provoking an abrupt braking of the latter against the great inertia force of its rotating mass. This operational condition is highly inconvenient, since it causes an intense wear of the crushing surfaces, usually defined by hard-material coatings applied to the cone head and to the upper housing.

Another negative aspect of the cone head rotating jointly with the eccentric element is the tendency of the crusher to violently throw, outwardly from the crushing cavity, the first particles of stone, ore, coal and others introduced into the crusher operating in the "no-load" mode, under the risk of causing injury to the operators and damages to the machine.

A known solution for preventing the cone head from rotating together with the eccentric element provides a sort of one-way locking clutch in the interior of the crusher, in order to prevent the cone head from being rotatively dragged by the eccentric element in the "no-load" operation of the crusher, but allowing the cone head to rotate in the direction opposite that of the upper housing, in the "on-load" operation of the crusher. However, this solution presents, as drawbacks, the high cost of the clutch and of its assembly, as well as maintenance difficulties. Furthermore, in the "on-load" operational condition, the cone head is frequently forced to rotate in the locking direction of the clutch, damaging the latter.

SUMMARY OF THE INVENTION

In view of the problems mentioned above, it is one of the objects of the present invention to provide an anti-spin system for the head of a cone crusher of the type considered herein, presenting a simple construction of a relatively low cost and which can be easily installed and maintained, preventing the cone head from rotating with the eccentric element, when the crusher is in the "no-load" operation.

As already mentioned, the present anti-spin system is directed to a cone crusher of the type which comprises: a structure in which are mounted an upper housing and a vertical axle having an upper end; an eccentric element mounted around the vertical axle, to be rotated by a drive mechanism; and a cone head disposed in the interior of the upper housing and being axially and rotatively supported on the structure, above the upper end of the vertical axle and radially and rotatively supported around the eccentric element.

According to a first aspect of the invention, the anti-spin system comprises a braking bush, carried by one of the parts defined by the cone head and by the structure, and an annular shoe carried by the other of said parts, the braking bush and the annular shoe being pressed against each other, by action of the inertial centrifugal force acting on the cone head upon "no-load" operation of the crusher, so as to generate a friction force opposite and superior to the friction force generated between the cone head and the eccentric element and to prevent the cone head from being rotationally dragged by the eccentric element.

In a particular way of carrying out the invention, the braking bush and the annular shoe are carried by the respective parts of cone head and structure, in a region thereof disposed in the interior of the cone head and axially positioned between the axial and radial supporting regions, respectively, of the cone head to the structure and to the eccentric element.

Further according to a way of carrying out the invention mentioned above, the cone head carries the braking bush in its interior, the annular shoe being defined in a region of the structure, as for example, around the vertical axle, confronting the braking bush.

The constructive system defined above provides a simple and strong frictional braking means, capable of preventing the rotation of the cone head with the eccentric element, whenever no material is being crushed in the crushing cavity.

Apart from providing a braking force in a direction opposite to that of the frictional dragging force between the cone head and the eccentric element, the system of the present invention can also lead to a reduction of said frictional dragging force, by reducing the axial extension of the radial bearing of the cone head around the eccentric element, in the minimum eccentricity region of the latter.

The constructive characteristic cited above allows to substantially reduce the frictional contact area, that is, the radial bearing area between the cone head and the eccentric element, in a region of said bearing which is opposite to that supporting the radial crushing loads in the "on-load" operation of the crusher, but which defines the region onto which the cone head exerts a greater pressure against the eccentric element, as a function of the inertial centrifugal force generated on the cone head, upon "no-load" operation of the crusher. Thus, the present constructive system also allows reducing the frictional dragging force of the cone head by the eccentric element, without reducing the radial bearing capacity of the cone head around the eccentric element, in the region of the latter which is subject to the radial crushing loads in the "on-load" operation.

BRIEF DESCRIPTION OF THE DRAWINGS

The invention will be described below, with reference to the enclosed drawings, referring to possible exemplary embodiments of the anti-spin system and in which.

DESCRIPTION OF THE INVENTION

Figure 1:
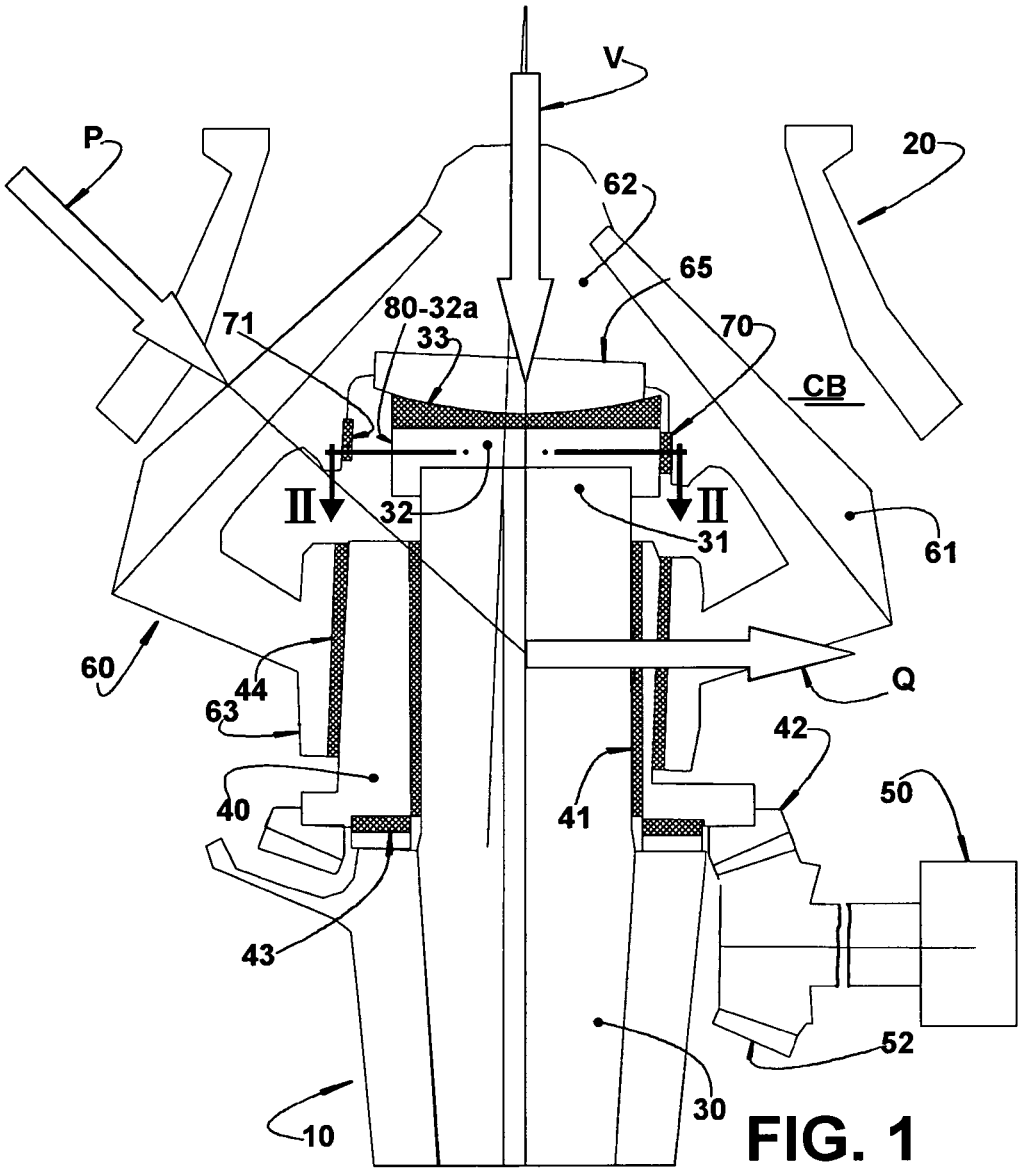
FIG. 1 represents a simplified schematic vertical sectional view of a cone crusher provided with the anti-spin system of the present invention, said figure containing arrows representative of crushing forces which actuate in the crusher in the "on-load" operation.

As previously mentioned, the invention is applied to a cone crusher of the type illustrated in FIG. 1 and which comprises a structure 10, on which is mounted a conical upper housing 20 constructed by any of the well known prior art manners and which is internally provided with a lining (not illustrated), in a material adequate to withstand the crushing forces. It should be understood that the particular constructive characteristics of the structure 10 are not described herein, since they have no effect on the construction or function of the anti-spin system object of the present invention.

The crusher further comprises a vertical axle 30, inferiorly fixed to the structure 10 and presenting a free upper end 31 which is generally positioned in the interior of the upper housing 20.

Around the vertical axle 30 is rotatively mounted, with the interposition of an inner tubular bushing 41, a tubular eccentric element 40 provided with a ring gear 42 which is engaged to a pinion 52 of a drive mechanism 50 mounted on the structure 10, in a disposition well known in the prior art. The mechanism is designed to produce the rotation or spin of the eccentric element 40 around the inner tubular bushing 41 mounted to the vertical axle 30. The eccentric element 40 is inferiorly axially seated on the structure 10, by means of an axial bearing 43, generally a sliding bearing of any adequate construction. The crusher of the type considered herein further comprises a cone head 60 of a well known prior art construction provided with an outer coating 61 in a material adequate to the crushing forces, the cone head being positioned in the interior of the upper housing 20 to define a crushing cavity CB therewith.

The cone head 60 has an inner upper portion 62 which is axially and rotatively seated on the structure 10, above the free upper end 31 of the vertical axle 30, and an inner lower portion 63 which is radially journalled around the eccentric element 40, with the interposition of an outer tubular bushing 44.

In the figures of the enclosed drawings, the free upper end 31 of the vertical axle 30 carries a support 32 onto which is mounted a spherical bearing 33 onto which is axially and rotatively seated a spherical joint 65 affixed under the inner upper portion 62 of the cone head 60.

With the above known prior art construction, the cone head 60 is displaced in an oscillating movement around the vertical axle 30, when the eccentric element 40 is caused to rotate by actuation of the drive mechanism 50. The construction of the vertical axle 30 represented herein is considerably simplified and does not foresee a system which allows to vertically displace the cone head to adjust the dimension of the crushing cavity CB. However, it should be understood that the vertical axle 30 can have a tubular construction, so as to house, in its interior, a support rod (not illustrated) to be vertically displaced, for example, by a hydraulic actuating means inferiorly disposed in the structure 10, so that its upper end carrying the support 32, the spherical bearing 33, the spherical joint 65 and the cone head 60, is lifted and lowered, permitting adjusting the operational dimension of the crushing cavity CB.

It should be understood that the axial bearing of the cone head 60, as well as the adjustment of the operational dimension of the crushing cavity CB, can be carried out through other constructive solutions, known or not in the prior art, which do not alter the anti-spin system concept proposed by the present invention. An example of axial bearing of the cone head 60 and adjustment of the operational dimension of the crushing cavity CB is described and illustrated in patent application PI0504725-0, filed on Oct. 13, 2005, of the same applicant.

According to the invention, the anti-spin system comprises a braking bush 70, to be removably mounted to one of the parts defined by the cone head 60 or by the structure 10 and presenting, preferably, a cylindrical tubular shape obtained in any material adequate to operate a frictional braking means.

In the illustrated construction, the braking bush 70 is removably and internally mounted in the cone head 60, coaxially to the latter and axially positioned between the radial and axial bearing regions of the cone head 60 to the structure 10 and to the eccentric element 40, respectively. The braking bush 70 presents a contact cylindrical surface 71 which, in the illustrated assembly, is radially internal.

The fixation of the braking bush 70 to the part which carries it, for example, to the cone head 60, can be made of different manners which allow its reliable fixation to the cone head 60 or to the structure 10.

The anti-spin system further comprises an annular shoe 80 carried by the other of the parts defined by the cone head 60 and by the structure 10, in an axial positioning coinciding with that of the braking bush 70, i.e., between the radial and axial bearing regions of the cone head 60 to the structure 10 and to the eccentric element 40, respectively.

Against the annular shoe 80, the braking bush 70 is radially pressed and frictioned in a determined operational condition of the crusher. In the illustrated construction, the annular shoe 80 has a circumferential and radially outer contact cylindrical surface 32*a*, defined in the support 32 which is fixed onto the free upper end 31 of the vertical axle 30. It should be understood that the annular shoe 80 can be also defined by an annular element preferably removably affixed around the support 32 or other element affixed to the structure of the crusher, as the vertical axle 30. In the illustrated construction, the annular shoe 80, carried by the structure 10, has its radially outer contact cylindrical surface 32*a* confronting the contact cylindrical surface 71 of the braking bush 70.

Thus, according to the proposed system, each of the parts of braking bush 70 and annular shoe 80 presents a contact cylindrical surface 71, 32*a*, the contact cylindrical surface 71 of that part carried by the cone head 60 surrounding and confronting the innermost contact cylindrical surface 32*a*, of that other part carried by the structure 10, in order to be radially pressed and frictioned against the innermost contact cylindrical surface 32*a* in a tangential contact region diametrically coincident with a region of minimum eccentricity of the eccentric element 40, by the inertial centrifugal force T acting on the cone head 60 when the crusher is in the "no-load" operation.

Figure 3:
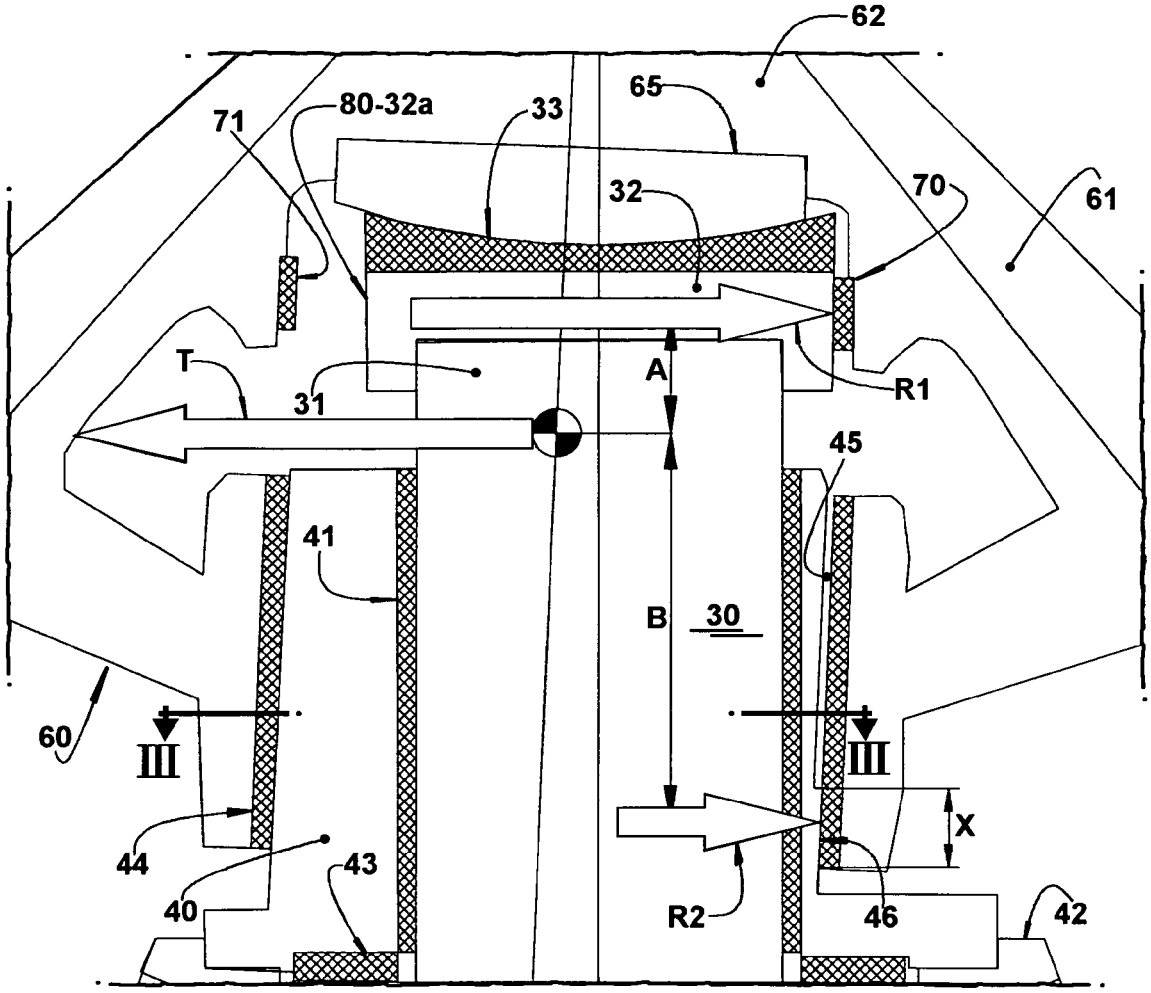
FIG. 3 represents a schematic and somewhat enlarged vertical section of part of the cone head, upper housing and vertical axle of the crusher illustrated in FIG. 1, but with the anti-spin system provided with an additional constructive characteristic, said figure containing arrows representative of radial forces which actuate in the crusher upon "no-load" operation.
Figure 3A:
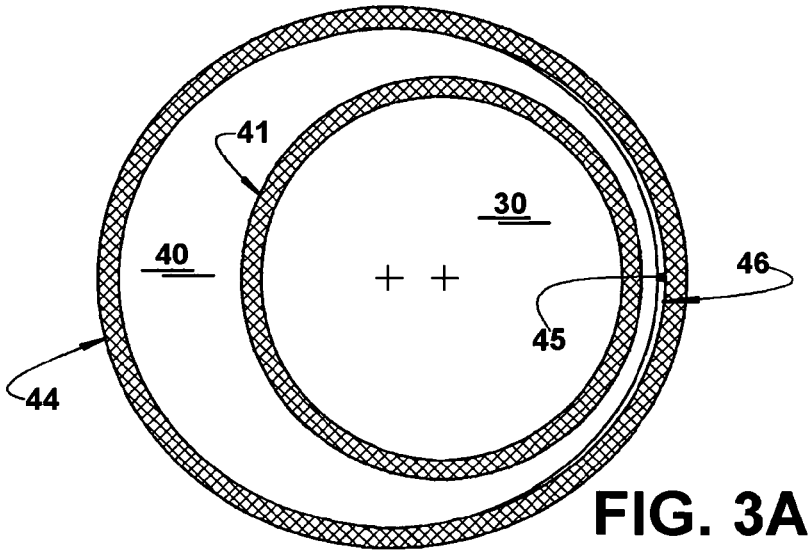
FIG. 3A represents a cross-section of the eccentric element, taken according to line in FIG. 3.

The tangential and frictional contact between the braking bush 70 and the annular shoe 80 is dimensioned to generate a friction force R1 opposite and superior to the friction force R2 generated between the cone head 60 and the eccentric element 40, through the outer bushing 44, as indicated by the arrows illustrated in FIG. 3, preventing the cone head 60 from being rotatively dragged by the eccentric element 40.

Figure 2:
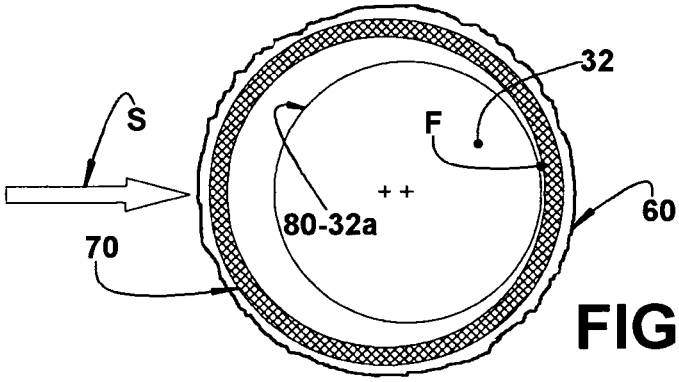
FIG. 2 represents a sectional view, taken according to arrows II-II in FIG. 1, illustrating the relative positioning between the braking bush, carried by the cone head, and the annular shoe carried by the structure of the crusher.

As illustrated in FIG. 1, when the crusher operates "on-load", a crushing force P is applied to the cone head 60. A horizontal component Q of this crushing force P is transmitted to the eccentric element 40 through the outer bushing 44 and the vertical component V is supported by the spherical bearing 33. In this operational condition, the horizontal component Q of the crushing force P is applied in a direction diametrically opposite to that of maximum eccentricity of the eccentric element 40, as illustrated by arrow S in FIG. 2, forcing the region of the cone head 60, opposite that of maximum eccentricity of the eccentric element 40, to move away from the adjacent confronting region of the vertical axle 30 which carries the spherical bearing 33. Thus, when the crusher is operating "on-load", the crushing force P makes the braking bush 70 radially and slightly move away from the annular shoe 80, in the frictional contact region opposite to that of maximum eccentricity of the eccentric element 40, there defining a small radial gap F sufficient only to minimize or even annul any friction between the parts of braking bush 70 and annular shoe 80, upon "no-load" operation of the crusher (FIG. 2).

When the crusher is under "no-load" operation, as illustrated in FIG. 3, the crushing force P disappears and the cone head 60, which is subject to the friction with the eccentric element 40 through the outer bushing 44, tends to rotate with the eccentric element 40, being subject to the inertial centrifugal force T which actuates in a direction opposite to that of the horizontal component Q of the crushing force P and radially forces the braking bush 70 to have frictional contact with the annular shoe 80, generating a friction force R1 superior to the friction force R2 generated by the contact of the cone head 60 with the eccentric element 40 through the outer bushing 44. With this solution, the cone head 60 is prevented from rotating by the rotational dragging of the eccentric element 40 when the crusher is under the "no-load" operation.

As illustrated in FIG. 3, the braking bush 70 and the annular shoe 80 are positioned in a plane transversal to the vertical axle 30, which presents a small axial distance A from the mass center of the cone head 60, in which acts the inertial centrifugal force T to which the cone head is submitted upon rotation of the eccentric element 40. Thus, the friction force between the braking bush 70 and the annular shoe 80 is applied to the cone head 60 at a relatively small axial distance A from the mass center of the cone head 60, considering the total height of the latter.

On the other hand, the usual axial dimension of the radial bearing of the cone head 60 around the eccentric element 40, that is, the axial dimension of the outer bushing 44 throughout the whole circumferential extension thereof makes that the friction force (frictional dragging), provided by said radial bearing in the "no-load" operation of the crusher, be the result of the intensity of the inertial centrifugal force T and also from the dimension of the axial extension of the contact region between the cone head 60 and the eccentric element 40, which region is that of minimum eccentricity of the eccentric element 40.

Thus, besides providing the braking friction force against the cone head 60 in the "no-load" operation of the crusher, the invention has also the additional object of providing a reduction of the dragging friction force of the cone head 60 by the eccentric element 40.

For reducing the dragging friction force of the cone head 60 through the eccentric element 40, the latter has its minimum eccentricity region provided with a recess 45 which extends downwards from an upper edge of the eccentric element 40, so as to define, in a lower portion of said region, a bearing surface 46 for the cone head 60, with an axial extension X which is reduced but sufficient to support the inertial centrifugal force T actuating on the cone head 60 in the "no-load" operation of the crusher.

With this construction, the friction force R2, which tends to provoke the rotational dragging of the cone head 60, is considerably reduced and is applied to the cone head 60 at an axial distance B from its mass center, much larger than the axial distance A between the actuating region of the braking friction force R1 and said mass center of the cone head 60. Hence, the inertial centrifugal force T is applied with more intensity, on the braking frictional tangential contact region between the braking bush 70 and the annular shoe 80.

Figure 4:
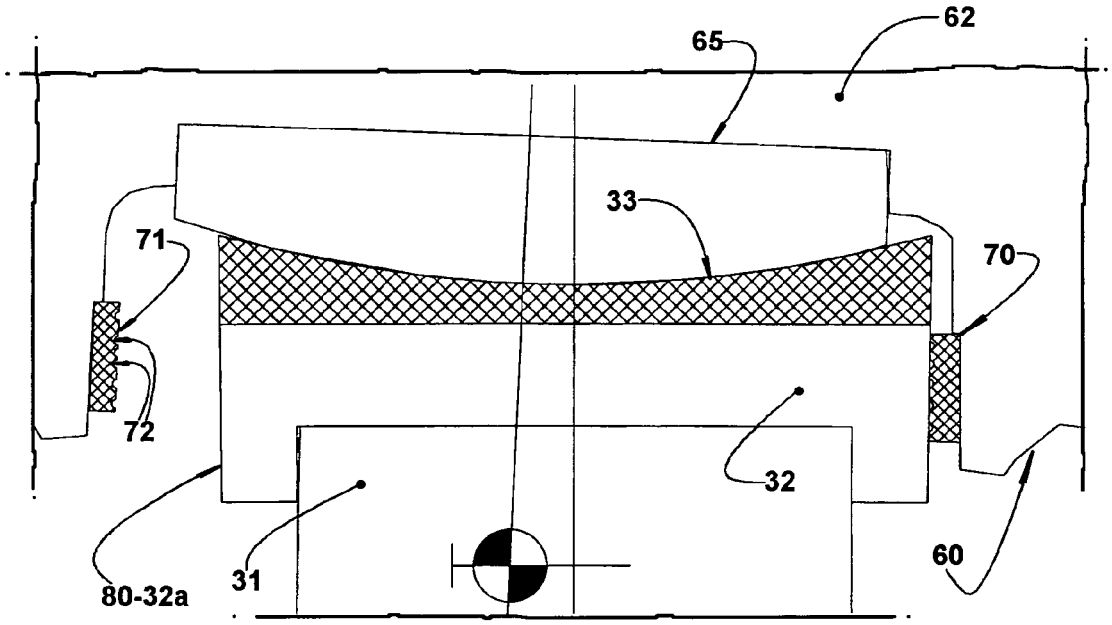
FIGS. 4 and 5 represent the same enlarged detail of parts of braking bush and annular shoe illustrated in FIGS. 1, 2 and 3, said parts being constructed in two embodiments which increase the friction therebetween.
Figure 5:
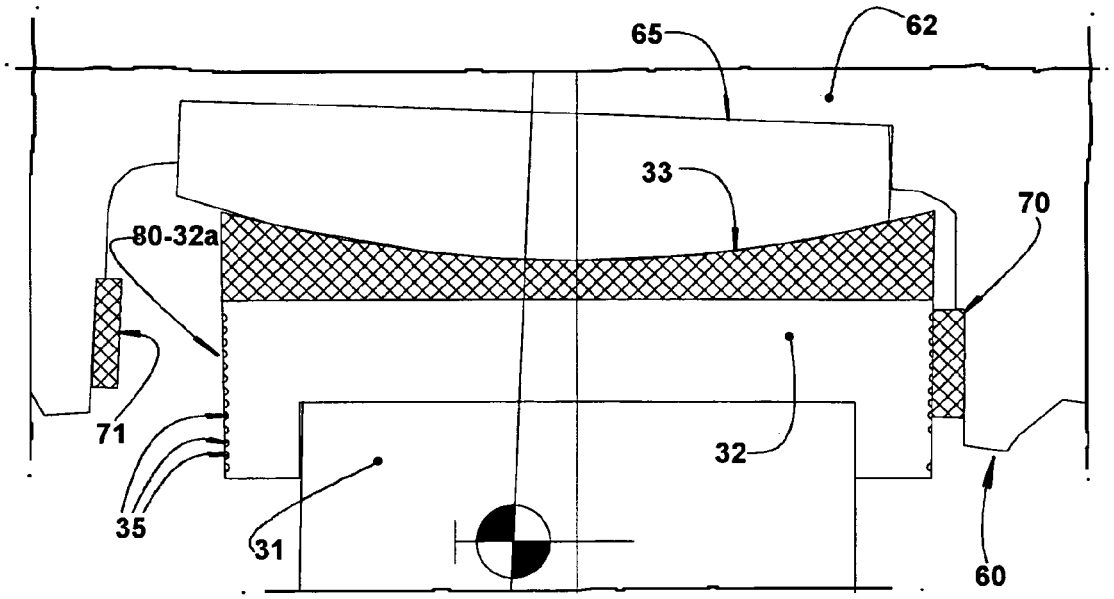

FIGS. 4 and 5 illustrate possible constructions which can be applied to the braking bush 70 or to the annular shoe 80, to increase the braking friction between said parts, upon "no-load" operation of the crusher.

In the illustrated construction in FIG. 4, the radially inner contact cylindrical surface 71 of the braking bush 70, to be frictioned by the radially external contact cylindrical surface 32*a* of the annular shoe 80, is provided with grooves 72 which can have different forms, as long as they facilitate releasing the oil coming from said contact cylindrical surfaces 71,32*a*. The oil retention in said contact cylindrical surfaces can cause the formation of a friction-reducing oil film, impairing the braking action to be obtained with the frictional contact between the braking bush 70 and the annular shoe 80.

In the illustrated construction in FIG. 5, the contact cylindrical surface 32*a* of the annular shoe 80 is provided with grooves 35, which operate in the same manner as described above for the grooves 72 provided on the contact cylindrical surface 71 of the braking bush 70.

Figure 6:
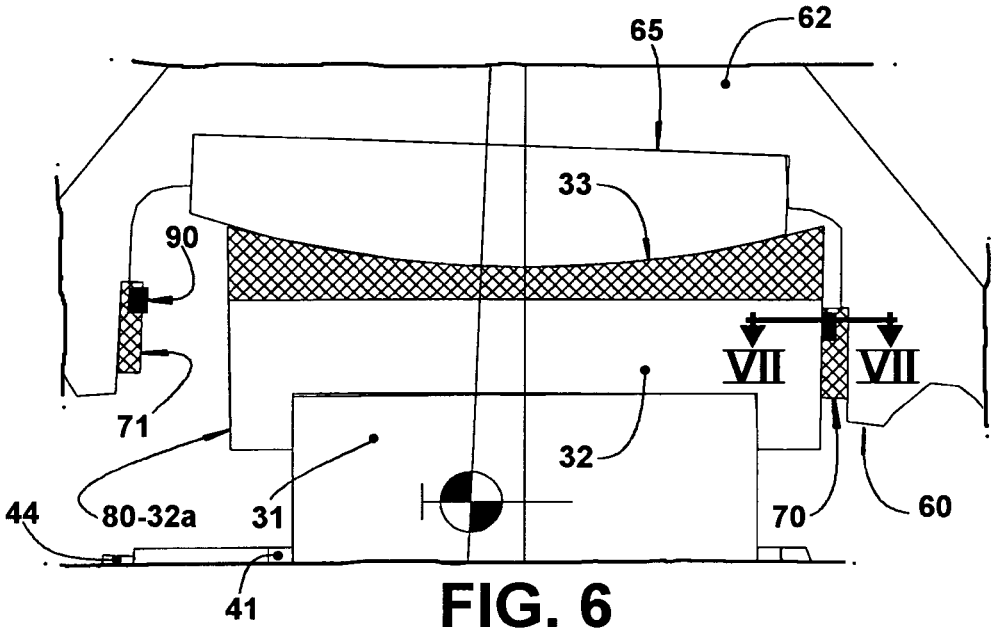
FIG. 6 represents an enlarged detail of the braking bush and annular shoe illustrated in FIGS. 1, 2 and 3, but with the crusher in the "no-load" operation and with the braking bush carrying, in its radially inner contact cylindrical surface, a ring made of a high-friction coefficient material.
Figure 7:
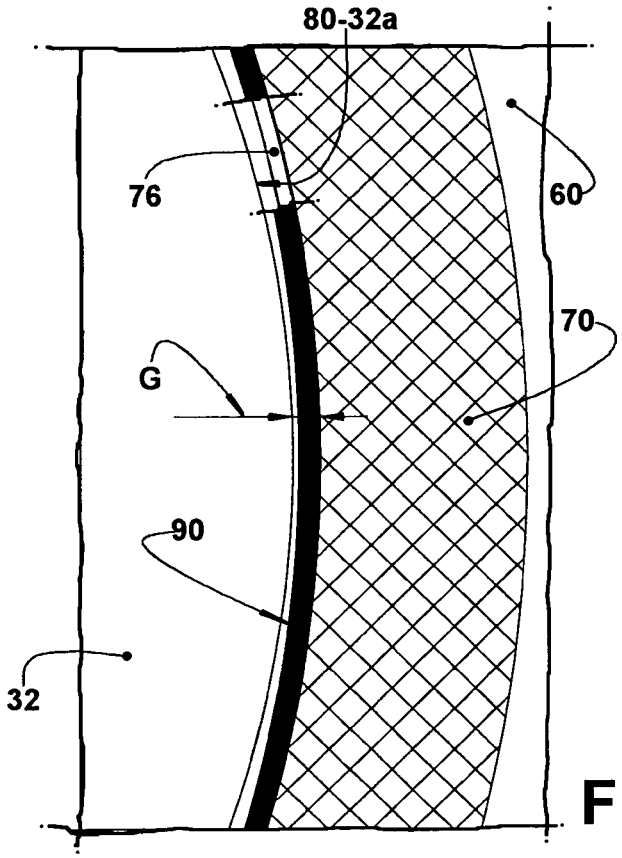
FIG. 7 represents an enlarged sectional view taken according to arrows VII-VII of FIG. 6, but with the crusher operating "on-load".

FIGS. 6 and 7 illustrate another constructive form to increase the friction between the braking bush 70 and the annular shoe 80, with the use of at least one ring 90, in a high-friction coefficient material, as for example, rubber or other adequate plastic material, which is fitted and retained in a respective circumferential channel 76 which, in the exemplified construction, is provided on the contact cylindrical surface 71 of the braking bush 70. It should be understood that the ring 90 can be fitted and retained in a channel (not illustrated) provided on the contact cylindrical surface 32*a* of the annular shoe 80 or also in both said contact cylindrical surfaces 71,32*a*.

The ring 90 is designed to project radially outwards from the contact cylindrical surface which carries it, so as to occupy, almost completely, the whole radial gap G which is formed between the braking bush 70 and the annular shoe 80, in the region corresponding to that of minimum eccentricity of the eccentric element 40, when the crusher operates "on-load", as illustrated in FIG. 7.

In this common "on-load" operation of the crusher, the horizontal component Q of the crushing force P maintains the radial gap G between the parts of braking bush 70 and annular shoe 80, minimizing or even avoiding the contact between the ring 90 and the confronting cylindrical surface of the other of said parts, as illustrated in FIG. 7.

When the crusher is under the "no-load" operation, the inertial centrifugal force T makes the ring 90 be pressed and frictioned against the confronting contact cylindrical surface of the other of said parts of braking bush 70 and annular shoe 80, in said region axially aligned with that of minimum eccentricity of the eccentric element 40, increasing the braking friction therebetween, as the condition illustrated in FIG. 6.

Nevertheless, the ring 90 can have its projecting radial extension dimensioned so that the ring 90 is continuously frictioned against the other contact cylindrical surface, in said region axially aligned with that of minimum eccentricity of the eccentric element 40, upon "on-load" and "no-load" operations of the crusher.

Although some constructive variants for the elements involved with the automatic rotational braking system of the cone head have been illustrated herein, it should be understood that such constructive variants are only exemplary, it being possible for a person skilled in the art to suggest other different construction forms to said elements, without departing from the inventive concept contained in the claim set accompanying the present specification.

The invention claimed is:

1. An anti-spin system for the head of a cone crusher of the type which comprises a structure (10), in which are mounted an upper housing (20) and a vertical axle (30) having a free upper end (31); an eccentric element (40) mounted around the vertical axle (30), to be rotated by a drive mechanism (50); and a cone head (60), disposed in the interior of the upper housing (20) and being axially and rotatively supported on the structure (10) above the free upper end (31) of the vertical axle (30) and radially and rotatively supported around the eccentric element (40), wherein said cone head (60) has a mass center, said anti-spin system further comprising a braking bush (70), carried by one of the parts defined by the cone head (60) and by the structure (10) and an annular shoe (80) carried by the other of said parts, the braking bush (70) and the annular shoe (80) being pressed against each other, by action of the inertial centrifugal force (T) acting on the mass center of the cone head (60) upon "no-load" operation of the crusher, so as to generate a braking friction force (R1) opposite to a dragging friction force (R2) generated between the cone head (60) and the eccentric element (40);

characterized in that said braking bush (70) and annular shoe (80 lie an axial distance (A) from the mass center of the cone head (60) smaller than an axial distance (B) between said mass center and the region in which acts the dragging friction force (R2) in the minimum eccentricity region of the eccentric element (40), said braking friction force (R2) being superior to the dragging friction force (R2) preventing the cone head (60) from being rotationally dragged by the eccentric element (40).

2. The system as set forth in claim 1, characterized in that the braking bush (70) and the annular shoe (80) are carried by the respective parts of cone head (60) and structure (10), in a region of said parts disposed in the interior of the cone head (60) and axially positioned between the axial and radial supporting regions of the cone head (60) on the structure (10) and on the eccentric element (40), respectively.

3. The system as set forth in claim 2, characterized in that at least one of the parts of braking bush (70) and annular shoe (80) is removably mounted to the respective part of cone head (60) and of structure (10) which carries it.

4. The system as set forth in claim 3, characterized in that each of the parts of braking bush (70) and annular shoe (80) presents a contact cylindrical surface (71,32*a*), the contact cylindrical surface (71) of that part carried by the cone head (60), surrounding and confronting the innermost contact cylindrical surface (32*a*) of that other part carried by the structure (10), in order to be radially pressed and frictioned against the innermost contact cylindrical surface (32*a*), in a tangential contact region diametrically coincident with a region of minimum eccentricity of the eccentric element (40), by the inertial centrifugal force (T) acting on the cone head (60) when the crusher is in the "no-load" operation.

5. The system as set forth in claim 4, characterized in that the braking bush (70) is removably mounted in the interior of the cone head (60) and has a radially inner contact cylindrical surface (71), the annular shoe (80) being defined in a region of the structure (10) and having its radially outer contact cylindrical surface (32*a*) confronting the contact cylindrical surface (71) of the braking bush (70).

6. The system as set forth in claim 5, characterized in that the annular shoe (80) has its contact cylindrical surface (32*a*) defined in a support (32) affixed to the vertical axle (30).

7. The system as set forth in claim 6, characterized in that at least one of the contact cylindrical surfaces (71, 32*a*) is provided with oil release grooves (72, 32*b*).

8. The system as set forth in claim 7, characterized in that at least one of the contact cylindrical surfaces (71, 32*a*) is provided with at least one circumferential channel (76) in which is fitted and retained a ring (90) in a material of high-friction coefficient and which projects radially from the contact cylindrical surface which carries it, so as to provide frictional contact with the other contact cylindrical surface, in a region axially aligned with that of minimum eccentricity of the eccentric element (40) upon "no-load" operation of the crusher.

9. The system as set forth in claim 7, characterized in that at least one of the contact cylindrical surfaces (71, 32*a*) is provided with at least one circumferential channel (76) in which is fitted and retained a ring (90), in a material of high-friction coefficient and which projects radially from the contact cylindrical surface which carries it, so as to continuously provide frictional contact with the other contact cylindrical surface, in a region axially aligned with that of minimum eccentricity of the eccentric element (40), upon "no-load" and "on-load" operations of the crusher.

10. The system as set forth in claim 9, characterized in that the eccentric element (40) has its minimum eccentricity region provided with a recess (45), which extends downwards from an upper edge of the eccentric element (40) so as to define, in a lower portion of said region, a bearing surface (46) for the cone head (60) with an axial extension (X) which is reduced but sufficient to support the inertial centrifugal force (T) which actuates on the cone head (60) upon "no-load" operation of the crusher.

* * * * *